US009101195B2

(12) United States Patent
Owoc

(10) Patent No.: US 9,101,195 B2
(45) Date of Patent: Aug. 11, 2015

(54) ARTICLE AND METHOD FOR PREVENTING SLEEP LINES

(71) Applicant: Victor Owoc, Cooper City, FL (US)

(72) Inventor: Victor Owoc, Cooper City, FL (US)

( * ) Notice: Subject to any disclaimer, the term of this patent is extended or adjusted under 35 U.S.C. 154(b) by 88 days.

(21) Appl. No.: 13/868,841

(22) Filed: Apr. 23, 2013

(65) Prior Publication Data

US 2014/0311512 A1 Oct. 23, 2014

(51) Int. Cl.
*A45D 44/00* (2006.01)
*A45D 44/22* (2006.01)
*A41D 20/00* (2006.01)

(52) U.S. Cl.
CPC ..... *A45D 44/22* (2013.01); *A41D 20/00* (2013.01); *A45D 44/002* (2013.01)

(58) Field of Classification Search
CPC ..... A61F 13/12; A61F 9/00; A61F 5/56; A45D 44/22; A41D 20/00
USPC ..... 2/206, 15, 12, 173, 209.13, 209.3, 69, 2/9; 128/848, 206.19, 857, 200.24, 128/205.25, 206.13, 206.21, 206.27, 128/206.28, 207.11; 132/319; 604/289, 604/303; 602/17, 44, 45, 46, 54, 76, 74, 61; 606/204.15
See application file for complete search history.

(56) References Cited

U.S. PATENT DOCUMENTS

| | | | | |
|---|---|---|---|---|
| 3,709,225 | A | 1/1973 | Sobel | |
| 3,949,741 | A | 4/1976 | Hofmann | |
| 5,116,675 | A | 5/1992 | Nash-Morgan | |
| 5,582,585 | A | 12/1996 | Nash-Morgan | |
| 6,039,710 | A * | 3/2000 | Kelley et al. | 602/74 |
| 7,384,377 | B2 * | 6/2008 | Berman | 482/11 |
| 7,632,217 | B2 | 12/2009 | Rooney | |
| 8,088,141 | B1 * | 1/2012 | Reyna | 606/204.35 |
| 2003/0167556 | A1 * | 9/2003 | Kelley | 2/206 |
| 2006/0106330 | A1 * | 5/2006 | Andrade et al. | 602/74 |
| 2010/0229275 | A1 * | 9/2010 | Wilson | 2/15 |

FOREIGN PATENT DOCUMENTS

| | | | | |
|---|---|---|---|---|
| DE | 2010040046 | * | 3/2012 | A45D 44/22 |
| DE | 102010040046 | * | 3/2012 | A45D 44/22 |

* cited by examiner

*Primary Examiner* — Todd Manahan
*Assistant Examiner* — Majid Jamialahmadi
(74) *Attorney, Agent, or Firm* — Ted W. Whitlock

(57) ABSTRACT

A method and article of manufacture for reducing facial wrinkles, namely sleep lines, formed during sleep. The article is formed having an inner and outer surface wherein each surface has higher or lower friction coefficients relative to one another. The higher friction coefficient inner surface holds the article in place against the skin and the lower friction coefficient outer surface facilitates movement of the face relative to the bedding during sleep.

12 Claims, 5 Drawing Sheets

ARTICLE AND METHOD FOR PREVENTING SLEEP LINES

BACKGROUND OF THE INVENTION

The present invention relates to an article of manufacture and method for reducing facial wrinkles, particularly wrinkles which form on the face or forehead of a person during sleep as a result of oblique compression of the facial skin contacting the bed or pillow (bedding) when the person is sleeping.

Human skin forms planar discontinuities, commonly-called wrinkles, as the person ages. Much effort and cost have been expended in attempts to prevent wrinkle-formation and/or to reduce the severity of already-formed wrinkles. These efforts have taken a variety of forms, including formulation of medicants, such as specialty creams, salves, or lotions; and other treatments, such as vapor treatments, mud packs, massage exercises, and even invasive electric, injectable, or surgical procedures which have been developed and used.

Even when age-caused wrinkles can be temporarily reduced, a particular type of wrinkle has eluded effective treatment—that is, wrinkles that form during sleep due to compression of the facial skin against bedding, such as a pillow or mattress. These are referred to herein as "sleep lines," a term which is readily understood in the art of dermatological treatments as presenting an entirely different type of wrinkle due to its cause from actual contact and compression of the face against a pillow or bedding during sleep.

Previous facial treatments, including wrinkle treatments include, for example, U.S. Pat. No. 3,709,3225, which describes a figure contouring mask having an absorbent surface to retain a figure contouring lotion in contact with the chin and the upper portion of the neck and held tightly in place by elastic head bands and elastic neck bands. However, this contouring mask does not cover the forehead where sleep lines are prevalently formed, nor does it provide inner and outer surfaces having different friction coefficients useful for preventing sleep line formation.

U.S. Pat. No. 3,949,741, which provides a method and appliance for reducing facial wrinkles by tightly applying to wrinkle-prone areas of the human face a pressure-sensitive adhesive appliance in such a manner that the skin under the appliance is placed in a flattened and smoothed configuration. The appliance remains in place for at least four hours and then is removed in a manner to strip dead skin cells from the skin. The adhesive can cause discomfort during sleep and when removed.

U.S. Pat. Nos. 5,116,675 and 5,582,585 teach devices directed to a disposable adhesive neck and facial wrinkle gathering device which includes a central elastic portion and opposingly extending non-elastic adhesive strips connected at each end thereof, and an improved disposable form of the device. According to the inventor, because of the nonexpandable nature of the adhesive strips, the device described in the '675 patent is uncomfortable to wear during long periods of use, such as during sleep. The device described in the '585 describes a disposable device which includes an elongated fully elastic main strip formed of flexible non-woven hypoallergenic elastic tape which, when positioned, stretches and flattens wrinkles. These devices do not completely encircle the face or forehead and are not useful to prevent sleep lines.

U.S. Pat. No. 7,632,217 describes a face exercising device comprising: a stretchable mask having a central aperture for a wearer's face; two connectable top straps connectable behind the wearer's head for securing the top to the wearer's forehead; two connectable bottom straps for attaching the mask to the wearer's chin; and a top strap affixed to the top of the mask for attaching to the back of the wearer's head. This device does not provide coverage of the forehead area and is not conducive to be worn during sleep to reduce sleep lines.

The present invention is based on the discovery of a method and device for use therewith which can minimize the wrinkling effects (sleep lines) caused by compression of the facial skin against bedding during sleep.

BRIEF SUMMARY OF THE INVENTION

It is, therefore, an object of the invention to prevent or reduce facial wrinkles formed during sleep, also known as "sleep lines." The present invention includes an article of manufacture and method for preventing or reducing sleep lines, which can appear during sleep as a result of oblique compression of the facial skin contacting the bed or pillow (bedding) when the person is in a prone or other sleeping position. One aspect of the invention relates to system comprising a headband and/or face mask having an inner (skin-contacting) surface and an outer (bedding-contacting) surface wherein each surface provides a different friction coefficient relative to the other surface.

More specifically, the inner (skin-contacting) surface provides a higher friction coefficient than the outer (bedding-contacting) surface so that the article resists movement or shifting of position in relation to the skin of the face or forehead, and facilitates or lowers resistance to movement relative to the bedding.

It is a further object of the invention to provide a method which can be used without specialized skills, and, therefore, allow the method to be practiced by the user. It is yet a further object of the invention to provide such method which is relatively inexpensive and within the financial means of nearly all users.

The article can be used with or without other treatments, such as facial cream or lotions; however, when used in conjunction with other treatments, it is another object of the invention to provide an article and method for facilitating retention of the moisturizing lotion or cream on the face during sleep, preventing contact with the bedding from removing or wiping the lotion or cream from the face. At the same time, this method and article of manufacture can serve to protect bedding or linens from being soiled by a moisturizing face cream or lotion worn during sleep.

Additional objects of the invention will be readily apparent from the following disclosure and claims.

The present invention comprises a method whereby a covering for the forehead, such as a headband, or the cheek or jowl area of the face, such as a mask, is provided. The headband or mask, or both, can be placed or positioned so that it covers the area of the face in which sleep lines may form during sleep as a result of compression of the facial skin against bedding, such as a mattress, pillow, or other pad or cushion. The method can include placement of positioning of the headband or mask so that it gently stretches the skin so that wrinkles are not formed by the headband or mask. This gentle, skin-stretching position can be achieved by a relatively snugly fitting headband or mask, which is flexible enough to conform to the contour of the face, and further can be tightened against the skin. The tightening against the skin can be achieved by elasticity of the material forming the article, itself, or by an adjustable fastener affixed to one or more straps used to secure the headband or mask into a desired position.

A headband in accordance with the invention comprises at least a forehead cover portion comprising an inner surface contacting the skin of the forehead when in use, and an outer surface, contacting the bedding when in use during sleep. Advantageously, the inner surface comprises a material having a relatively higher friction coefficient, which can reduce or minimize movement or shifting of the headband relative to the skin or forehead. The outer surface of the headband comprises a material having a relatively lower friction coefficient which can facilitate movement, allowing for a sliding or gliding of the outer surface of the headband, relative to the bedding material. Thus the different friction coefficients of each of these surfaces helps to keep the headband in place or desired position on the forehead, and allows the head to more easily slide against the bedding during sleep.

Maintaining the position of the headband while allowing movement relative to the bedding can prevent or reduce compression of the skin against the bedding and provide a desired result of reduction or prevention of sleep lines which can form by such skin compression during sleep.

The material used for the forehead cover portion of the headband can be a single-layer or "single-ply" material having different inner and outer surfaces which provide the different friction coefficients. Alternatively, the forehead cover portion of the headband can be formed by two or more layers or "plies" whereby the outer surface is formed by one layer having a relatively lower friction coefficient, and the inner surface can be formed by a separate layer having a relatively higher friction coefficient. The layers or "plies" can be sewn or otherwise bonded together using, for example, a fabric adhesive.

A preferred material for forming the inner surface comprises a natural or polymeric fabric which "wicks" away moisture. Such fabrics are commercially available and are marketed, for example, as WICK-A-WAY (COMPANY/LOCATION). A preferred outer surface comprises a fabric having a relatively low friction coefficient, providing a slick outer surface, such as silk, satin, polyester, rayon, or the like, which is readily available at fabric stores.

The headband can be formed as a single annular band which can completely encircle the head. This configuration which would be recognized as being shaped similar to a sweatband commonly used in sports, but recognizing the difference in materials used to form the headband. Still, a headband of the subject invention can be formed using a flexible material or materials having a sufficient length and elastic properties for stretchingly fitting around the head and constricting into position.

A one-size-fits-all length is preferred, but varying lengths can be provided for different sizes of headband. For example, the different sizes can be provided consistent with standard adult and children hat sizes or in categories such as extra-small (XS), small (S), medium (M), large (L), or extra-large (XL) or the like.

The width of the headband can be uniform, or can vary, such as having a "stepped" profile, or can be tapered, whereby the width is sufficient to substantially cover the forehead area and tapers to a narrower width, forming a strap-like feature in the area reaching around the back of the head.

Alternatively, the headband can comprise a forehead covering portion which is generally rectangular (length>width) in shape, but allowing for variations of shapes, such as rounded corners, contoured edges, or the like.

The forehead cover portion preferably has a width sufficient to cover the frontal forehead area, for example from about the brow line to about the normal hairline of the user. The length of the forehead covering portion preferably extends across the entire forehead (e.g., from right-to-left outer points of the eyebrows or orbital sockets areas, or more preferably, from about the right temple to the left temple.

A forehead piece which extends across the forehead area only will preferably have a strap which extends the remaining distance to completely encircle the head at about the forehead level. The strap can be non-adjusting, which preferably comprises an elastic or stretchable strap, or can include a strap adjusting means as is commonly known.

Alternatively, the strap can be formed from two pieces, each affixed to and extending from a right and left end of the forehead portion and overlappingly connected to one another at their opposite end. The overlapping connection can be adjustably affixed or connected by a fastening or closure means such as a snap, snap-lock, clip, hook, adhesive tape, or hook-and-loop material (e.g., Velcro®) or other commonly known and available strap fastener.

In one alternative embodiment, the forehead cover portion can extend, or can include eye coverings attached separately or formed integral therewith, for blocking light which can interrupt a person's ability to sleep. In one preferred embodiment, the eye coverings can be folded or flipped up, or completely removed, such that the user can deploy the eye covering portion only when desired.

In another embodiment, the article of manufacture for preventing or reducing sleep lines can be a mask-like article, covering substantially the cheek or jowl area of the face. The mask embodiment comprises different inner and outer surfaces as described above for the headband embodiment. Any of the flexible materials described for the headband embodiment can be configured in the form of a mask, and worn during sleep to prevent or reduce sleep lines.

Preferably, the mask embodiment has an aperture for leaving open the center area of the face, including the nose and eyes. The mask embodiment can have integrally formed flaps which extend around the face and neck whereby the flaps are affixed to one another at the back of the neck and head. The flaps can be affixed by any standard closure means, such as a snap, zipper, clip, hook, or preferably, hook and loop material (e.g., Velcro®) for ease of use and comfort of the user.

Alternatively, the mask can be formed to cover only the cheek or jowl areas of the face, whereby one or more straps can be affixed to the edge or edges of the mask, and the straps further comprising an appropriate closure means, such as a hook and loop material affixed to the closing ends of the strap or straps. It has been found that a preferred embodiment can include a strap or bridging portion positioned over the upper lip area of the face which advantageously can provide tension between the right and left cheek cover portions of the mask The headband and mask embodiments can be used together, simultaneously, on alternating or periodic days or sleep cycles, or can be used separately.

In yet a further embodiment of the invention, the headband and mask embodiments can be formed integral with one another so that the article comprises a singular, combined headband and mask unit capable of preventing or reducing sleep lines when used during sleep.

BRIEF DESCRIPTION OF THE DRAWINGS

FIG. 1A shows a front view illustrating an elastic strap used for securing the headband in position on the head;

FIG. 1B shows a rear view illustrating an elastic strap used for securing the headband in position on the head;

FIG. 1C shows a rear view of a headband embodiment illustrating one alternative embodiment of the strap, namely overlapping straps fastened together using a hook-and-loop material, e.g., Velcro®; and FIG. 1D shows a rear view of a headband embodiment illustrating another alternative embodiment of the strap, namely an adjustable-size strap comprising a string-type adjustment means.

FIG. 2A shows a front view of an embodiment comprising a single wide or thick elastic band affixed at each end to a respective right and left side of the cheek or jowl cover portion of the mask;

FIG. 2B shows a front view of an alternative embodiment of the cheek or jowl cover portion of the mask comprising at least one thin or narrow strap affixed at each end to a respective right and left side of the cheek or jowl cover portion of the mask.

FIG. 3A shows a rear view of an embodiment comprising a single wide or thick elastic band affixed at each end to a respective right and left side of the cheek or jowl cover portion of the mask;

FIG. 3B shows a rear view of an alternative embodiment of the cheek or jowl cover portion of the mask comprising at least one thin or narrow strap affixed at each end to a respective right and left side of the cheek or jowl cover portion of the mask.

FIG. 4A shows a strap configuration comprising two (top and bottom) straps each comprising an adjusting clip.

FIG. 4B shows a strap configuration comprising two straps which crisscross.

DETAILED DESCRIPTION OF THE INVENTION

The subject invention can be described and understood by reference to the drawings, provided herein as FIGS. 1-5.

Figure 1A:
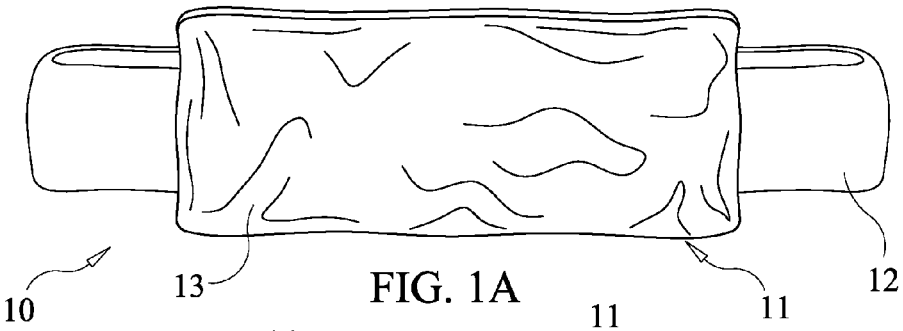
FIG. 1A, FIG. 1B, FIG. 1C, and FIG. 1D show front and rear views of a preferred headband embodiment of the present invention illustrating a forehead cover portion and strap.

Referring to FIG. 1, and specifically to FIG. 1A, a front view of headband 10 according to an embodiment of the invention, is shown wherein the headband 10 comprises a forehead cover portion 11 and a single strap 12. Forehead cover portion is preferably generally rectangular in shape, having its length (horizontal dimension) greater than its width (vertical dimension) as measured in its position during use. More preferably, the width is of forehead cover portion 11 is sufficient to cover substantially all of the forehead area, from above the brow line to about the normal hairline. The length of forehead cover portion 11 is preferably sufficient to cover substantially the forehead area extending from the outer edges of both orbital sockets. The length can also extend from right to left temple areas, or can extend the entire perimeter of the head.

Forehead cover portion 11 is shown having an outer surface 13 facing away from the forehead. Outer surface 13 is different or has different friction properties from an inner surface (shown as reference 14 in FIGS. 1B, 1C, and 1D) of the forehead cover portion. In accordance with the subject invention, outer surface 13 has a lower relative friction coefficient than the friction coefficient of its inner surface. It is understood that the relative friction coefficients for the inner and outer surfaces can be provided by two different fabrics or materials layered and bonded or sewn together, or can be provided by a single fabric or material having the differing friction coefficients on each of its inner and outer surfaces.

Strap 12 can be a material or fabric having elastic properties whereby the strap can be stretched to fit over the head and elastically return to size so that the headband fits snugly and comfortably around the head for proper positioning of the forehead cover portion.

One alternative embodiment comprises a single elastic strap 12 provided completely within an annular forehead cover portion 11 comprising two fabric layers surrounding the entire strap 12.

Figure 1B:
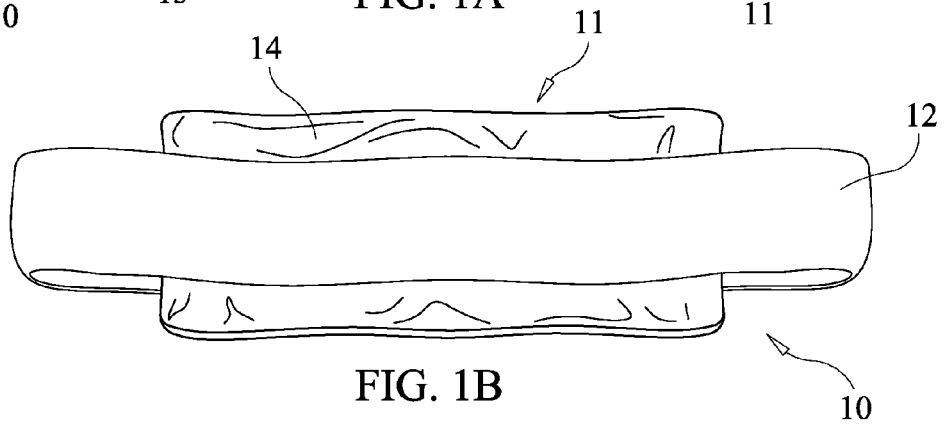

FIG. 1B shows a rear view of headband 10 comprising a forehead cover portion 11 and single elastic strap 12. Further, FIG. 1B illustrates the inner surface 14 of forehead cover portion 11. Inner surface 14 of the forehead cover portion is different from its outer surface (reference 13 in FIG. 1A). More specifically, the inner surface 14 comprises a material or fabric having a relatively higher friction coefficient than the friction coefficient of the material or fabric forming the outer surface.

Figure 1C:
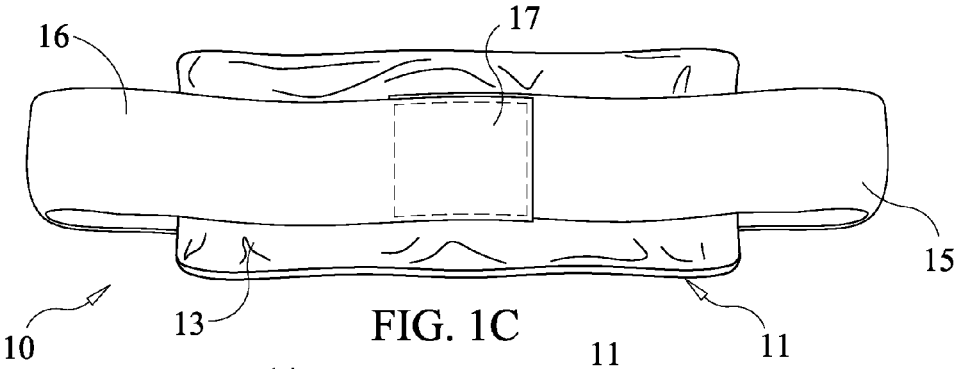

FIG. 1C is a rear view of an embodiment of headband 10 comprising another embodiment of a strap comprising left strap 15 and right strap 16 portions connected by connecting means 17. Connecting means 17 is illustrated here comprising hook-and-loop material (e.g., Velcro®) whereby the size of the headband can be adjusted to fit snugly and comfortably around the head of a user.

Figure 1D:
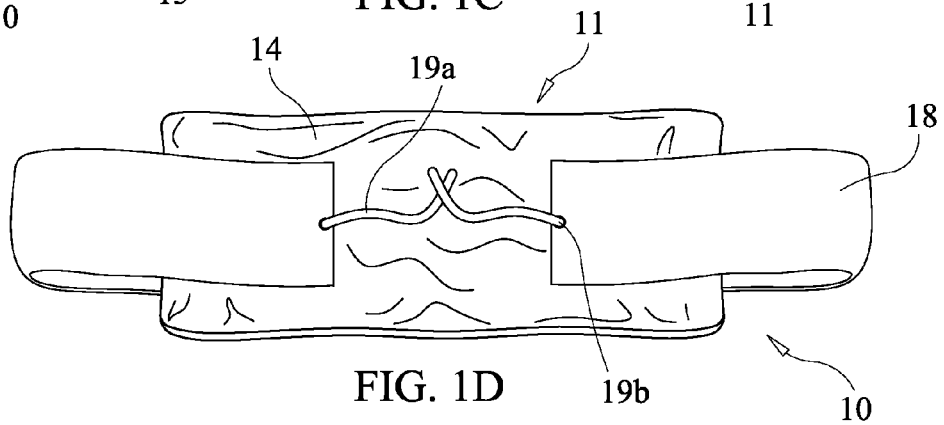

FIG. 1D is a rear view of an embodiment of headband 10 comprising yet another embodiment of a single strap 18 comprising connecting means 19*a* and 19*b*. Connecting means 19*a* and 19*b* comprises left and right strings or laces which can be tied together to adjust the size of the headband to fit snugly and comfortably around the head of a user.

Figure 2A:
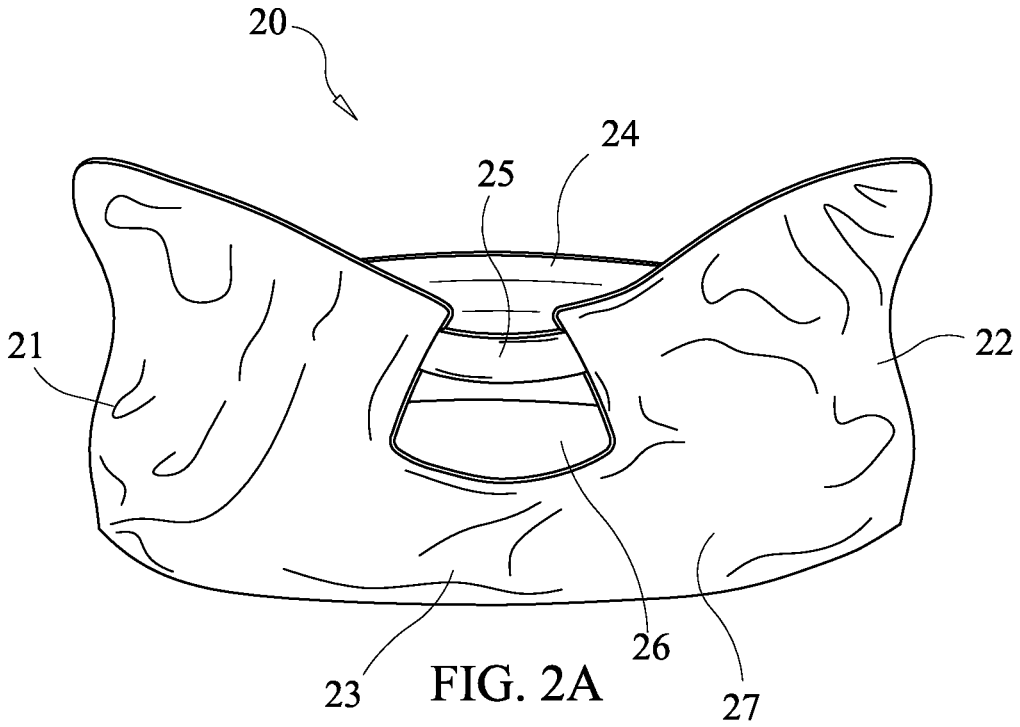
FIG. 2A and FIG. 2B show a front view of a preferred mask embodiments of the present invention illustrating a cheek or jowl cover portion and strap.

FIG. 2A shows a front view of a mask 20 in accordance with one embodiment of the invention. Mask 20 comprises left and right check or jowl cover portions 21 and 22, respectively, unitarily adjoined or formed with chin cover portion 23. Also shown is single strap 24, illustrating a wide strap configuration connecting to edges of right and left cheek or jowl cover portions 21 and 22. Also illustrated is a lip strap 25 which adjoins and connects the cheek or jowl cover portions 21 and 22 and bounding an aperture 26 so that the mouth remains uncovered by the mask.

The outer surface 27 of mask 20 comprises a material or fabric having a relatively lower friction coefficient than the friction coefficient of the material or fabric forming the inner surface (shown, for example, in FIG. 3A) of mask 20.

Figure 2B:
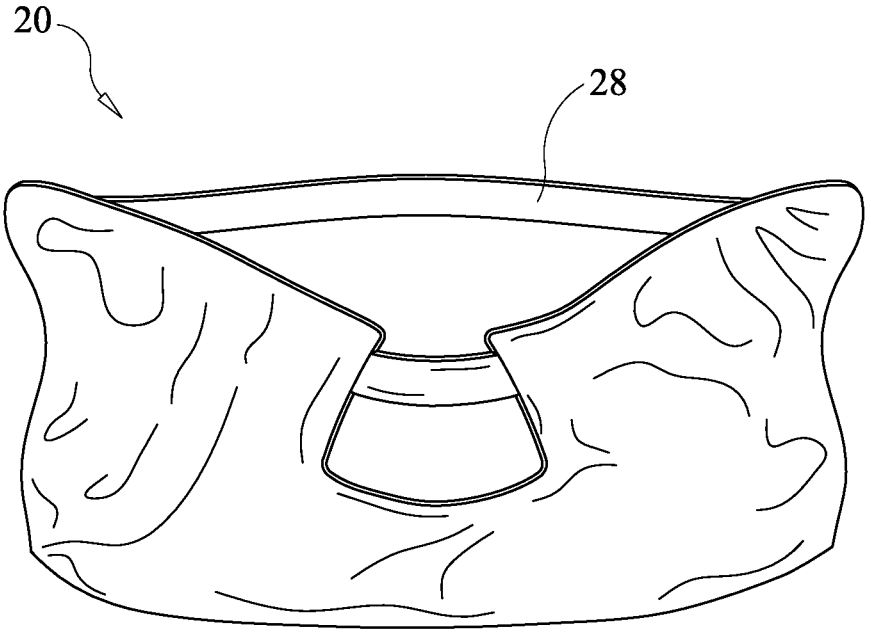

An alternative embodiment of a mask 20 in accordance with the subject invention is illustrated in FIG. 2B, wherein strap 28 comprises a relatively thin band of material or fabric having elastic properties. One or more additional straps (not shown) can also be provided in this embodiment, whereby a first strap 28 is provided at the top of the mask and at least one additional strap is provided at a lower position relative to first strap 28.

Figure 3A:
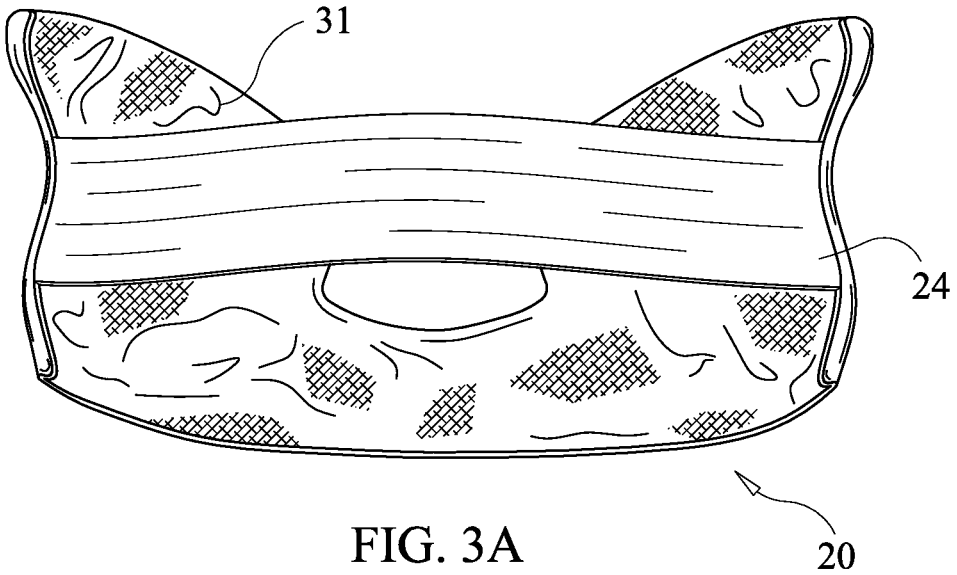
FIG. 3A and FIG. 3B show a rear view of the embodiments illustrated in FIG. 2A and FIG. 2B.
Figure 3B:
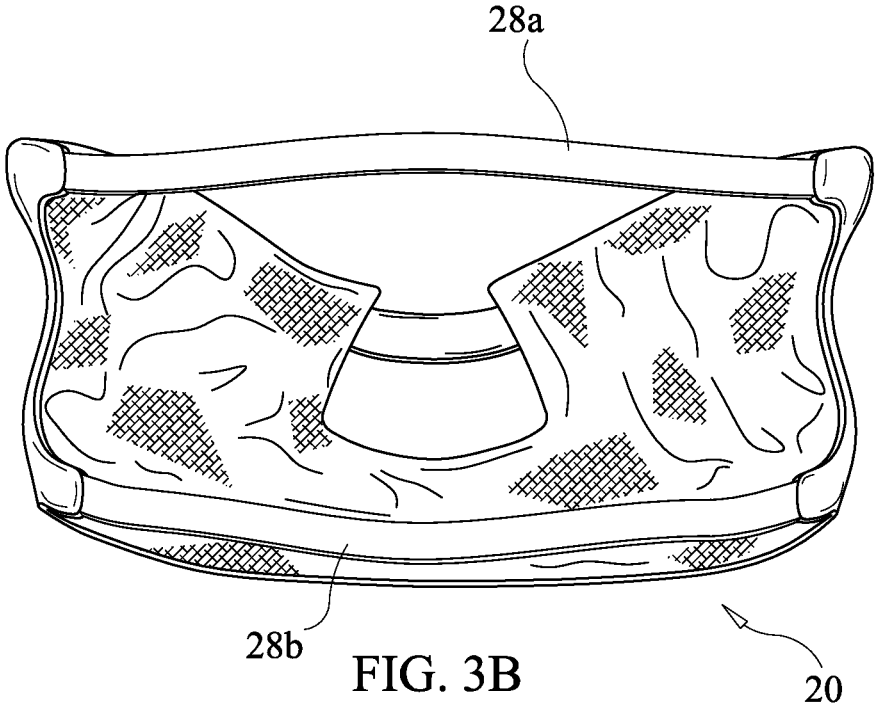

FIG. 3A shows a rear view of mask embodiment 20 comprising a single, wide strap 24. In addition, inner surface 31 is illustrated to indicate a material or fabric having a different (higher) friction coefficient relative to the outer surface material or fabric (illustrated in FIGS. 2A and 2B.) An alternative embodiment of mask 20 comprising at least one thin strap is shown in FIG. 3B, and specifically illustrates an embodiment comprising two thin straps 28*a* and 28*b*, wherein straps 28*a* and 28*b* are positioned relative to one another to provide tension at the top and bottom of the mask when worn or used by a user.

Figure 4A:
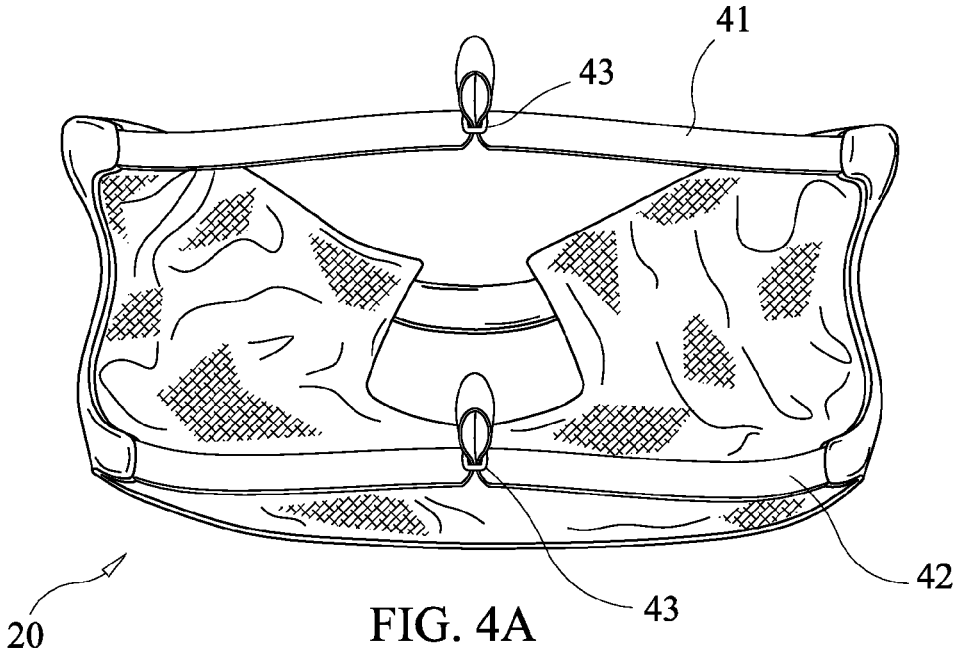
FIG. 4A and FIG. 4B show rear views of different strap configurations in accordance with a mask embodiment of the subject invention.
Figure 4B:
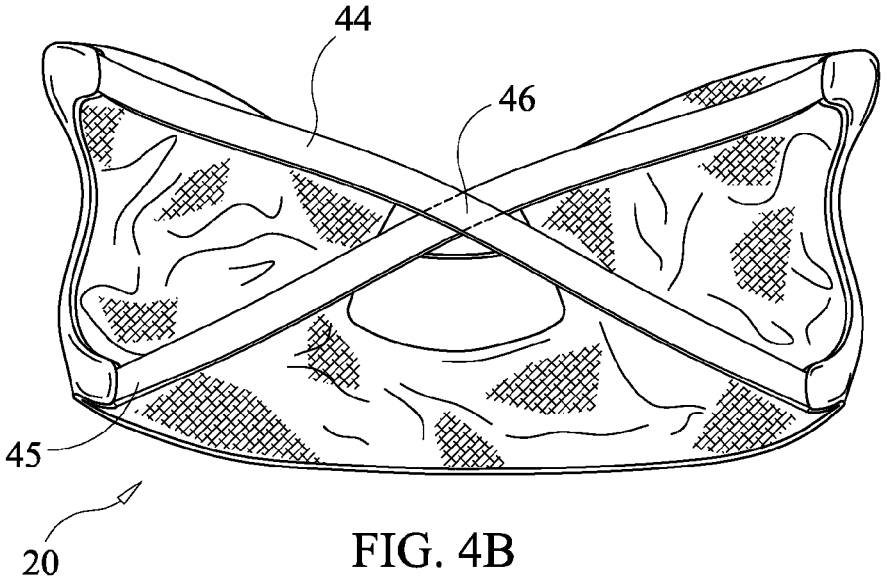

FIG. 4A is a rear view of an embodiment of mask 20 comprising two thin straps 41 and 42, each comprising an adjusting clip 43, whereby the adjustment clips 43 allow for gathering and securing the length of straps 41 and 42 at a particular desired length for sizing of the straps. It would be understood that the size adjustment means can be provided as any commonly known or available clip, snap, hook-and-loop, or other adjustable connecting device. Another alternative embodiment of mask 20 comprising more than one thin strap is illustrated in FIG. 4B, whereby thin strap 44 and thin strap 45 crisscross one another. Thin straps 44 and 45 crisscross at juncture 46, substantially in the center area of each, whereby thin straps 44 and 45 remain detached from one another at juncture 46, or can be adhered, sewn, or otherwise boded to one another to form a fixed juncture 46.

Figure 5:
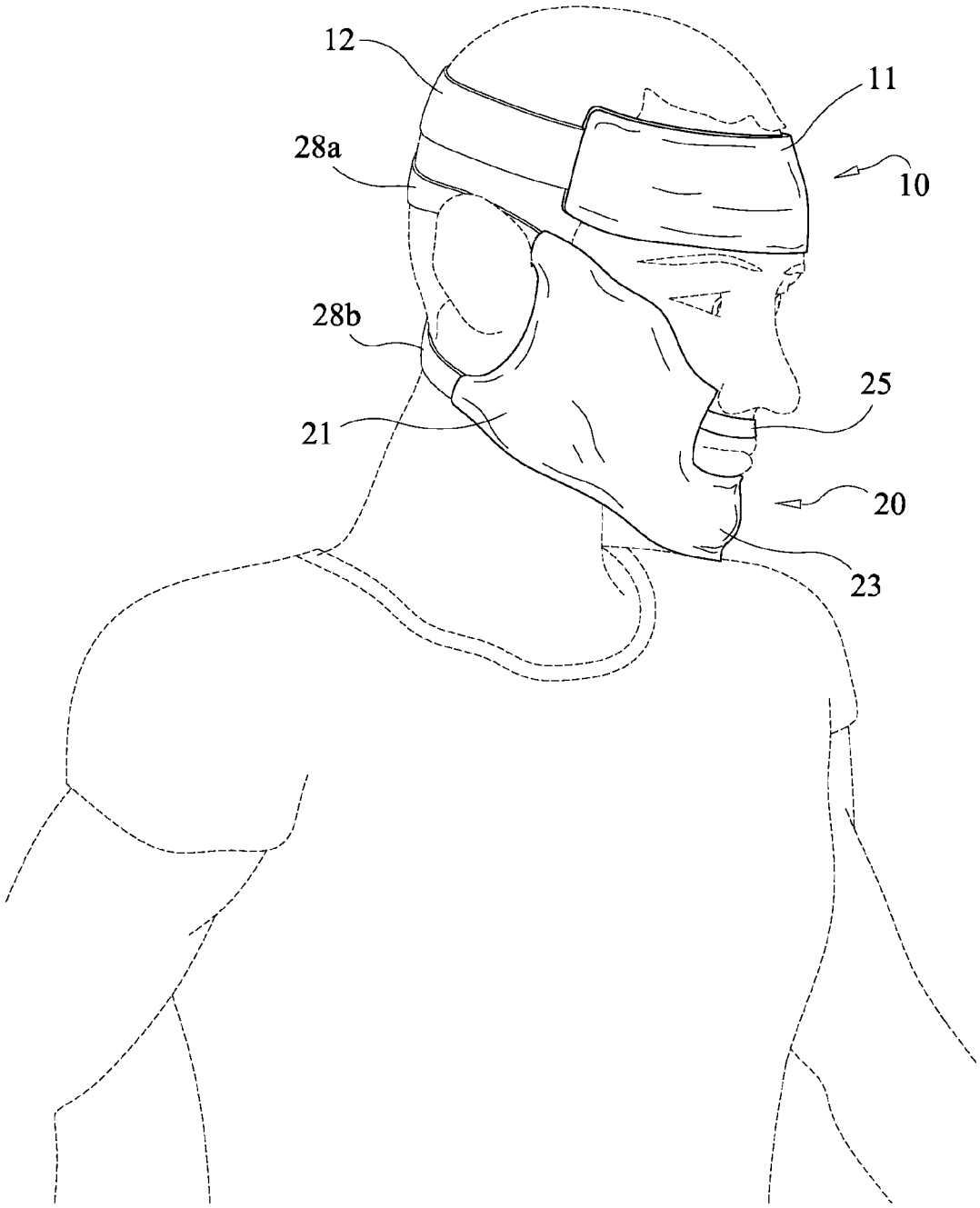
FIG. 5 is a perspective view of headband embodiment and a mask embodiment of the invention as worn by a user.

FIG. 5 illustrates headband 10 and mask 20 properly positioned on a face of a user when used during sleep to prevent or reduce formation of sleep lines. As shown in FIG. 5, headband 10 comprises forehead cover portion 11 and strap 12. Mask 20 comprises right cheek or jowl cover portion 21, chin cover portion 23, lip strap 25, and thin straps 28*a* and 28*b*. Although both embodiments are shown positioned on a user, it would be understood that a user can wear one embodiment without the other, for example, headband 10 can be used without mask 20 for preventing or reducing sleep lines on the forehead. Similarly, mask 20 can be used without headband 10 to prevent or reduce sleep lines forming on the cheek or jowl area of the face.

It would also be understood that an embodiment comprising a headband 10 and mask 20 can be configured as a single unit, formed as a combined headband and mask which can be worn to prevent or reduce sleep lines on the forehead and cheek or jowl area of the face.

In use, the headband or mask embodiments, or both, are positioned on the face so that the outer surface, comprising a relatively lower friction coefficient, is directed away from the skin of the user, and the inner surface, comprising a relatively higher friction coefficient is placed in contact with the skin of the user. The user then can sleep as normal while wearing the headband, mask, or both, and the relatively lower friction coefficient of the outer surface facilitates movement, such as a sliding or gliding movement, relative to the bedding. In addition, the relatively higher friction coefficient of the inner surface of the article facilitates maintaining the position of the facial skin, preventing or reducing the amount of compression against the bedding, and thereby reducing or preventing the likelihood of sleep line wrinkles forming on the face during sleep.

Specific quantitation of friction coefficients for each surface is not critical, but the relative friction coefficients for each surface are important for carrying out the proper use of the article. The friction coefficient for the inner surface of an article of the invention is preferably relatively greater than the friction coefficient for the outer surface of the article of the invention.

This relative difference in friction coefficients for each surface provides the operable feature of the invention. For example, the relatively higher friction coefficient of the inner surface can provide for maintaining the article in position on the face. A relatively higher friction coefficient for the inner surface can be achieved by the fabric or material itself, or can be achieved by a combination of the fabric or material and a wrinkle serum applied to the face by the user. Certain wrinkle sera are known to have slight adhesive properties or a natural "tackiness" when applied to the face of a user. A fabric or material used to form the inner surface of the article which interacts or is compatible with a wrinkle serum having the tackiness property can facilitate maintenance of position for the article.

The relatively lower friction coefficient for the outer surface of the article facilitates and promotes movement, such as sliding or gliding, of the article against the bedding whereby the facial skin is not compressed against the bedding for periods of time which can result in formation of sleep lines.

Thus, an article of manufacture of the invention comprises a relatively flat, flexible cover of the facial skin, which can be worn during sleep to prevent or reduce formation of sleep lines. The facial skin covering has one inner surface and one outer surface, whereby each surface has a different friction coefficient relative to one another, namely, a higher friction coefficient for the inner surface and a lower friction coefficient for the outer surface.

An article according to the invention, such as a headband or mask, can be manufactured by providing a material or fabric forming each inner and outer surface wherein the material or fabric has the desired relative friction coefficient. Typically, a first type of fabric or material is used to form the inner surface of the article, and a second fabric or material is used to form the outer surface of the article. The two fabrics or materials are cut to provide the desired shape and sewn, adhered, or otherwise bonded or adjoined together for form the desired article.

For example, a first fabric having a friction coefficient higher than a friction coefficient of a second fabric, can be used to form a forehead cover portion or cheek or jowl cover portion as described. The first fabric can be used in the manufacture of the article so that its higher friction coefficient forms the inner surface of the relevant portion of the article. The second fabric can be used in the manufacture of the article so that its lower friction coefficient forms the outer surface of the relevant portion of the article.

A preferred material for forming the inner surface comprises a natural or polymeric fabric which "wicks" away moisture. A preferred fabric useful for forming the inner surface is a two-way stretch lycra, which is commercially available and marketed, for example, as Wickaway lycra (Rose City Textiles, Portland, Oreg., USA). Other fabrics useful for the inner surface of the article include, but are not limited to, Wickaway mesh, micro-fiber, Cool Pass Mesh, or the like. A preferred outer surface comprises a fabric having a relatively low friction coefficient, providing a slick outer surface, such as silk, satin, polyester, rayon, or the like, which is also readily available from a fabric retailer or wholesaler. It is further contemplated that a single fabric having first and second surfaces whereby each of the first and second surfaces has a different friction coefficient, one relatively higher or lower than the other, can be used to form the inner and outer surfaces of the relevant portions of the article.

One or more straps can be used for securing the position of a headband or mask, whereby the strap or straps can be attached by sewing, adhering, or otherwise bonding or adjoining the strap or straps to the forehead cover or cheek or jowl cover portions of the article. A preferred material useful for forming a strap is an elastic or otherwise stretchable material which can expand to be placed over the head and return to its shape or form to comfortably secure the headband or mask in place during use.

Having thus described the invention it is clear that what may appear to be different embodiments could be provided without departing from the spirit and scope of the invention.

Hence it is intended that the foregoing specification and the accompanying drawing be interpreted as illustrative rather than in a limiting sense.

The invention claimed is:

1. An article of manufacture for preventing or reducing sleep line formation during sleep, wherein said article is a headband adapted to be worn on a head of a user and extend completely around the head of the user for preventing or reducing sleep lines on a forehead area of the user, said headband consisting of a forehead cover portion having an inner surface adapted to contact facial skin of a user and an outer surface contacting bedding, during sleep, whereby the inner surface has a friction coefficient relatively higher than a friction coefficient for the outer surface such that the higher friction coefficient facilitates maintaining position of the article relative to facial skin during sleep, and the outer surface facilitates movement relative to the bedding during sleep, whereby the relative movement prevents or reduces compression of the facial skin against the bedding; and at least one strap so that the article extends completely around the head of the user for securing the article in position on the head of a user wherein the forehead cover portion is substantially rectangular and has a length and width wherein the length is adapted to extend from a right temple area of a user to the left temple area of the user and width is adapted to extend extends from about the brow line to about the hairline of the user.

2. The article of claim 1 wherein the strap is elastic.

3. The article of claim 1 wherein the strap is adjustable in length.

4. The article of claim 3 wherein the adjustable strap comprises an adjustable connecting means selected from a clip, snap, hook, lacing, and hook-and-loop material.

5. The article of claim 1 wherein the outer surface comprises a material or fiber selected from silk, satin, polyester, and rayon.

6. An article of manufacture for preventing or reducing sleep line formation during sleep, wherein said article is a headband adapted to be worn on a head of a user and extend completely around the head of the user for preventing or reducing sleep lines on a forehead area of the user, said article consisting of a forehead cover portion which is substantially rectangular and has a length and width adapted to extend from a right temple area of a user to the left temple area of the user and from about the brow line to about the hairline of the user, said forehead portion having an inner surface adapted to contact facial skin of a user and an outer surface contacting bedding, during sleep, whereby the inner surface has a friction coefficient relatively higher than a friction coefficient for the outer surface such that the higher friction coefficient facilitates maintaining position of the article relative to facial skin during sleep, and the outer surface facilitates movement relative to the bedding during sleep, whereby the relative movement prevents or reduces compression of the facial skin against the bedding;

at least one strap so that the article extends completely around the head of the user; and at least one of an eye cover for blocking ambient light, a cheek or jowl cover portion, a chin cover portion or a lip strap.

7. The article of claim 6 wherein the strap is elastic.

8. The article of claim 6 wherein the strap is adjustable in length.

9. The article of claim 8 wherein the adjustable strap comprises an adjustable connecting means selected from a clip, snap, hook, lacing, and hook-and-loop material.

10. A method for preventing or reducing sleep line facial wrinkles resulting from compression of facial skin against bedding during sleep, said method comprising:

providing an article of manufacture which is a headband adapted to be worn on a head of a user for preventing or reducing sleep lines on a forehead area of the user, said headband consisting of:

a forehead cover portion which is substantially rectangular and has a length and width adapted to extend from a right temple area of a user to the left temple area of the user and from about the brow line to about the hairline of the user, said forehead portion having an inner surface adapted to contact facial skin of a user and an outer surface contacting bedding, during sleep, whereby the inner surface has a friction coefficient relatively higher than a friction coefficient for the outer surface such that the higher friction coefficient facilitates maintaining position of the article relative to facial skin during sleep, and the outer surface facilitates movement relative to the bedding during sleep; and at least one strap so that the article extends completely around the head of the user for securing the article in position on the head of a user placing, before sleep, the article in position to cover an area of the face susceptible to sleep line formation; and wearing the article during sleep.

11. The method of claim 10 wherein the strap is adjustable in length.

12. The method of claim 10, further comprising application of a wrinkle serum onto the facial skin prior to placing the article into position.

* * * * *